US008062060B2

(12) United States Patent
Rejman

(10) Patent No.: US 8,062,060 B2
(45) Date of Patent: Nov. 22, 2011

(54) INTERFACE ELEMENT, INTERFACE ELEMENT HOLDER, AND ELECTRICAL APPLIANCE

(75) Inventor: Marcin Rejman, Waiblingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 12/865,650

(22) PCT Filed: Dec. 5, 2008

(86) PCT No.: PCT/EP2008/066851

§ 371 (c)(1),
(2), (4) Date: Jul. 30, 2010

(87) PCT Pub. No.: WO2009/095130

PCT Pub. Date: Aug. 6, 2009

(65) Prior Publication Data

US 2011/0003504 A1 Jan. 6, 2011

(30) Foreign Application Priority Data

Jan. 30, 2008 (DE) ..... 10 2008 000 188

(51) Int. Cl.
*H01R 13/60* (2006.01)

(52) U.S. Cl. ..... 439/527

(58) Field of Classification Search ..... 439/527, 439/532, 567, 572

See application file for complete search history.

(56) References Cited

U.S. PATENT DOCUMENTS

| | | | | |
|---|---|---|---|---|
| 6,436,569 | B1 | 8/2002 | Dijkstra et al. | |
| 6,561,848 | B1 * | 5/2003 | Khemakhem et al. | 439/580 |
| 6,761,593 | B2 * | 7/2004 | Hu | 439/668 |
| 6,762,585 | B2 * | 7/2004 | Liao | 320/107 |
| 6,884,089 | B2 * | 4/2005 | Obikane et al. | 439/74 |
| 6,895,276 | B2 * | 5/2005 | Kast et al. | 607/37 |
| 6,910,916 | B2 * | 6/2005 | Murakami | 439/532 |
| 7,047,077 | B2 * | 5/2006 | Hansen et al. | 607/37 |
| 2008/0099224 | A1 | 5/2008 | Hofmann et al. | |

FOREIGN PATENT DOCUMENTS

| | | | |
|---|---|---|---|
| DE | 10040893 | A1 | 8/2001 |
| DE | 10318947 | A1 | 11/2004 |
| DE | 102004032790 | A1 | 2/2006 |
| GB | 2432036 | A | 5/2007 |
| JP | 10296660 | A | 11/1998 |
| WO | 0065674 | A1 | 11/2000 |

* cited by examiner

*Primary Examiner* — Jean Duverne
(74) *Attorney, Agent, or Firm* — Ronald E. Greigg

(57) ABSTRACT

The invention relates to an interface element to be fixed on and/or in an interface element holder of an electrical appliance, which element includes a hard component portion. The invention provides a positioning portion which is formed from an elastic material and makes it possible for the hard component portion to move relative to the interface element holder as a result of deformation. The invention also relates to an interface element holder and to an electrical appliance.

23 Claims, 3 Drawing Sheets

INTERFACE ELEMENT, INTERFACE ELEMENT HOLDER, AND ELECTRICAL APPLIANCE

CROSS-REFERENCE TO RELATED APPLICATION

This application is a 35 USC 371 application of PCT/EP2008/066851 filed on Dec. 5, 2008.

BACKGROUND OF THE INVENTION

1. Field of the Invention

The invention relates to an interface element, an interface element holder, an electrical appliance, and a use of any thereof.

2. Description of the Prior Art

Interface elements, which necessarily also include interface element assemblies, are used for an extremely wide variety of functions in electrical appliances. They are used wherever two parts, namely the interface element and an interface element holder are to be placed against each other or one inside the other. Frequently, an interface element is a battery tray cover for closing a battery tray (interface element holder) of an electrical appliance or is an (electrical) interface between a battery tray and an electric drive unit or set of electronics. Such interface elements customarily have electrical contacts that are affixed, usually by means of extrusion coating, to the interface element that is composed of hard plastic. In addition to or in lieu of an electrical contacting, known interface elements can fulfill an extremely wide variety of functions and to this end are provided, for example, with coding ribs, guide ribs, stop ribs, etc.

In actual practice, interface partners (interface element and interface element holder) require a strict adherence to tolerances relative to each other in order to permit the interface partners to be exactly positioned relative to each other.

In known interface partners, the positioning occurs either without play or with a definite play, i.e. in a floating fashion. In the positioning without play, an extremely precise fit should be achieved. In the floating positioning, however, the interface element should be able to move relative to the interface element holder, for example in order to compensate for tolerance deviations or vibrational movements. The known floating positioning includes the option of embodying the interface element in a resilient fashion by providing mechanical spring elements composed of rigid material, i.e. implementing a floating support with a nominal position and restoring forces. A non-resilient, i.e. free-floating, positioning of the interface partners is alternatively possible.

Interface partners that can be positioned relative to each other in a floating fashion as a rule have the disadvantage of an insufficient resistance to soiling, which causes the interface partners to lose their ability to move relative to each other over time, with the result that the interface partners can no longer sufficiently fulfill their functions. On the other hand, a fixed, play-free positioning has the disadvantage that there is no possibility at all of adjusting the interface partners relative to each other, thus limiting the utilization range of a play-free positioning.

In general, all known interface partners have the disadvantage that sudden stresses are absorbed by hard component sections and, particularly in the case of long-lasting stress, lead to fracturing or other types of damage.

OBJECT AND ADVANTAGES OF THE INVENTION

The object of the invention, therefore, is to propose an interface element as well as an interface element holder for an interface element that on the one hand, permit an exact relative positioning and on the other hand, reliably avoid damage. Another object is to propose a correspondingly optimized electrical appliance.

The invention is based on the concept of providing a positioning section composed of an elastic material that permits the hard component section of the interface element to move relative to the interface element holder. In this connection, the scope of the invention includes providing the positioning section on the interface element and/or on the interface element holder. It is only essential for the positioning section to be composed of a material that is more elastic (softer) than that of the hard component section of the interface element. In other words, the invention is comprised of providing a positioning section that is composed of an elastic material between the hard component section of the interface element and a hard component section of the interface element holder; this positioning section, due to its inherent elastic deformation, permits a relative movement between the two hard component sections of the interface partners. The embodiment of the positioning section out of an elastic material preferably permits the hard component section of the interface element to move relative to the interface element holder along all spatial axes. In addition, the elastic positioning section advantageously also permits a swiveling motion of the hard component section around at least one, but preferably all three, spatial axes. An interface element embodied according to the concept of the invention or an interface element holder embodied according to the concept of the invention combines only the advantages of a play-free positioning and a floating positioning, while avoiding their disadvantages. Thus on the one hand, it is possible to exactly position the interface partners relative to each other and at the same time, the resistance to soiling is increased. In other words, the relative movement function of the positioning section is not restricted due to soiling that occurs over the course of the service life since the relative movement between the at least one hard component section of the interface element and the at least one hard component section of the interface element holder is implemented only by means of an (internal) material deformation of the positioning section and not by means of a sliding relative movement. In addition, a greater mechanical strength is achieved than with a positioning that is play-free and floats in a sliding fashion. Furthermore, the mechanical ruggedness, in particular the ultimate strength, is increased due to the shock absorption function of the positioning section. In particular, the presence of the positioning section achieves an improved damping behavior. This in turn results in an improved vibration resistance as compared to known positioning mechanisms. Furthermore, the accuracy of fit is optimized in comparison to known floating positioning mechanisms. Moreover, the tolerance limits to be respected can be loosened due to the fact that the positioning section is composed of an elastic material.

When embodying the positioning section, it should be noted that the characteristic curves of the elastic material turn out to be highly nonlinear in comparison to those of spring elements, i.e. low restoring forces are achieved close to the neutral position and relatively high restoring forces are achieved at the end of the relative movement path.

In the context of the invention, an "interface element" is understood to include all components or assemblies that fulfill the role of a functional interface between two functional elements of the electrical appliance. Preferably, as will be explained in greater detail below, the interface element is an electrical interface element with an electrical contact for producing an electrical connection between a battery tray and/or rechargeable battery tray and the actual electrical appliance, in particular the at least one electric motor and/or the electronics of the electrical appliance. In this connection, the scope of the invention includes having the interface element be permanently or detachably connected to the interface element holder. An essential feature is that when the interface element and interface element holder are affixed to each other and/or when the interface partners are assembled, a relative movement is permitted between the hard component section of the interface element and a hard component section of the interface element holder.

In an advantageous modification of the invention, both the positioning section and the hard component section are composed of, plastic and at room temperature, i.e. at approximately 20° C., the plastic comprising the positioning section is softer than the plastic material comprising the hard component section. Plastic elastomer material is particularly suitable for embodying the positioning section. In a particularly preferred embodiment, the positioning section is composed of a thermoplastic elastomer material (TPE).

In an advantageous modification of the invention, the positioning section directly contacts the hard component section of the interface element and/or of the interface element holder. To this end, it is possible for the positioning section to be embodied as a component that is separate from the hard component section and for the components to be situated resting against each other, preferably in a form-locked fashion. Preferably, however, the positioning section and the hard component section are embodied in the form of a non-detachable composite component, in particular a multicomponent injection-molded part. Preferably, it is embodied in the form of a two-component plastic extrusion coating.

In a particularly advantageous embodiment of the interface element and/or interface element holder, at least one functional section is affixed to the hard component section of the interface element or to a hard component section of the interface element holder or else the respective hard component section itself comprises the functional section. It is thus possible, for example, for the hard component section to have or constitute at least one electrical contact or at least one coding rib and/or at least one guide rib and/or at least one stop rib. In an embodiment of this kind, the hard component section is assigned essentially hard, static functions whereas the positioning section is assigned the soft, dynamic functions, in particular absorbing vibrations, impacts, and other forces and ensuring a mobility of the interface element relative to the interface element holder. Preferably, the positioning section also produces restoring forces, for example in order to act on contacts, which are affixed to the hard component section, with a spring force oriented in the direction toward a battery or a rechargeable battery.

As mentioned at the beginning, in a preferred embodiment of the interface element in form of an electrical interface element, a functional section embodied in the form of an electrical contact is provided; the electrical contact, i.e. the functional section, is used to produce an electrically conductive connection between a battery and/or a rechargeable battery and electrical equipment, in particular a drive motor, and/or a set of electronics of the electrical appliance. In a particularly preferred embodiment, the at least one electrical contact is extrusion coated with the hard component section of the interface element. In a particularly preferred embodiment, the hard component section is in turn extrusion coated at least partially, in particular at the edges, with the positioning section composed of an elastic material.

In addition to the above-described interface element and the above-described interface element holder, the invention also discloses an electrical appliance equipped with an above-described interface element and/or an above-described interface element holder. It is possible here for both the interface element and the interface element holder to each have a respective positioning section composed of an elastic material; the two positioning sections rest directly against each other in the assembled state. It is particularly preferable, however, for a positioning section composed of an elastic material to be either associated with only the interface element or associated with only the interface element holder; in the assembled state, the positioning section directly contacts a hard component section of the respective other component of the interface element holder or interface element.

The invention also discloses a use of an above-described interface element and/or above-described interface element holder in or on an electrical appliance, in particular a power tool or household appliance, particularly preferably in or on a power tool, in particular for producing an interface between two functional sections of the electrical appliance.

BRIEF DESCRIPTION OF THE DRAWINGS

Other advantages, defining characteristics, and details of the invention ensue from the following description of preferred exemplary embodiments and from the drawings, in which.

DESCRIPTION OF THE PREFERRED EMBODIMENTS

Figure 1:
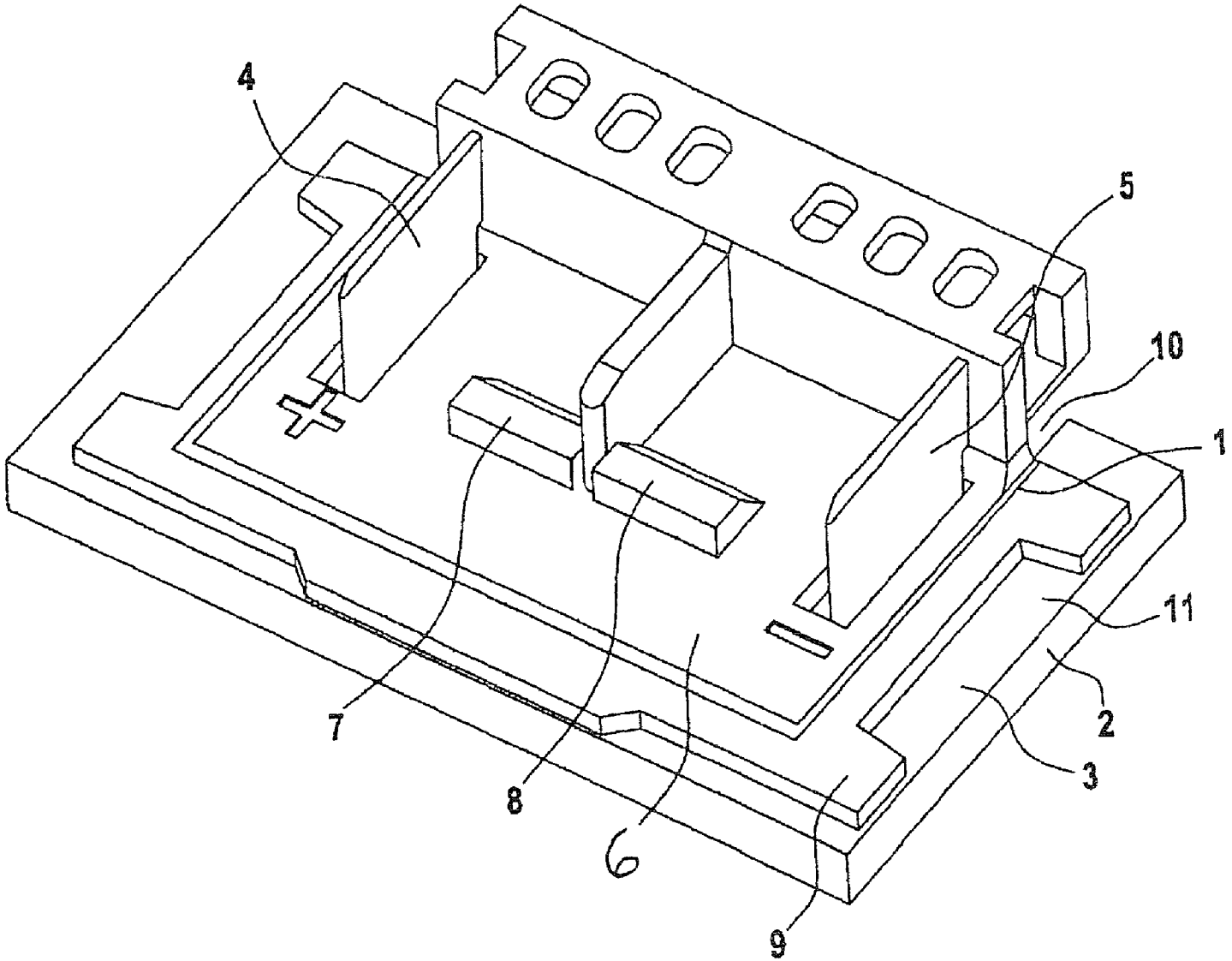
FIG. 1 is a perspective view of an arrangement including an interface element and an interface element holder; the interface element is depicted in a view from below.

In the drawings, components that are the same or have the same function are labeled with the same reference numerals.

FIG. 1 shows an arrangement composed of an interface element embodied as an electrical interface element 1 and an interface element holder 2 that holds the interface element 1. In the exemplary embodiment shown, the interface element holder 2 is a component of a housing 3 of an electrical appliance that is not shown in detail, including an electric drive motor that is likewise not shown.

The interface element 1, which is permanently held in the interface element holder 2 once they are assembled, cooperates with functional sections 4, 5 embodied in the form of electrical contacts to produce the electrical contact between rechargeable batteries, not shown, and the electric drive motor, likewise not shown, of the electrical appliance.

The drawing (see Fig.) shows a hard component section 6 of the interface element 1 with which the functional elements 4, 5 embodied in the form of metallic electrical contacts are extrusion coated. The hard component section 6 also has additional functional sections 7, 8 embodied in the form of coding ribs formed onto it.

The hard component section 6 is extrusion coated at its edges by a positioning section 9 composed of an elastomer material, in this case TPE. The composite component (in this case a multicomponent injection molded part) including the hard component section 6 and the positioning section 9 is secured in a clamping fashion in a recess 10 of a hard component section 11 of the interface element holder 2 with the aid of the positioning section 9. Due to the elastic embodiment of the positioning section 9, the hard component section 6, with its functional sections 4, 5, 7, 8, is able to move, within certain limits, in all spatial directions relative to the hard component section 11 of the interface element holder 2.

Figure 2:
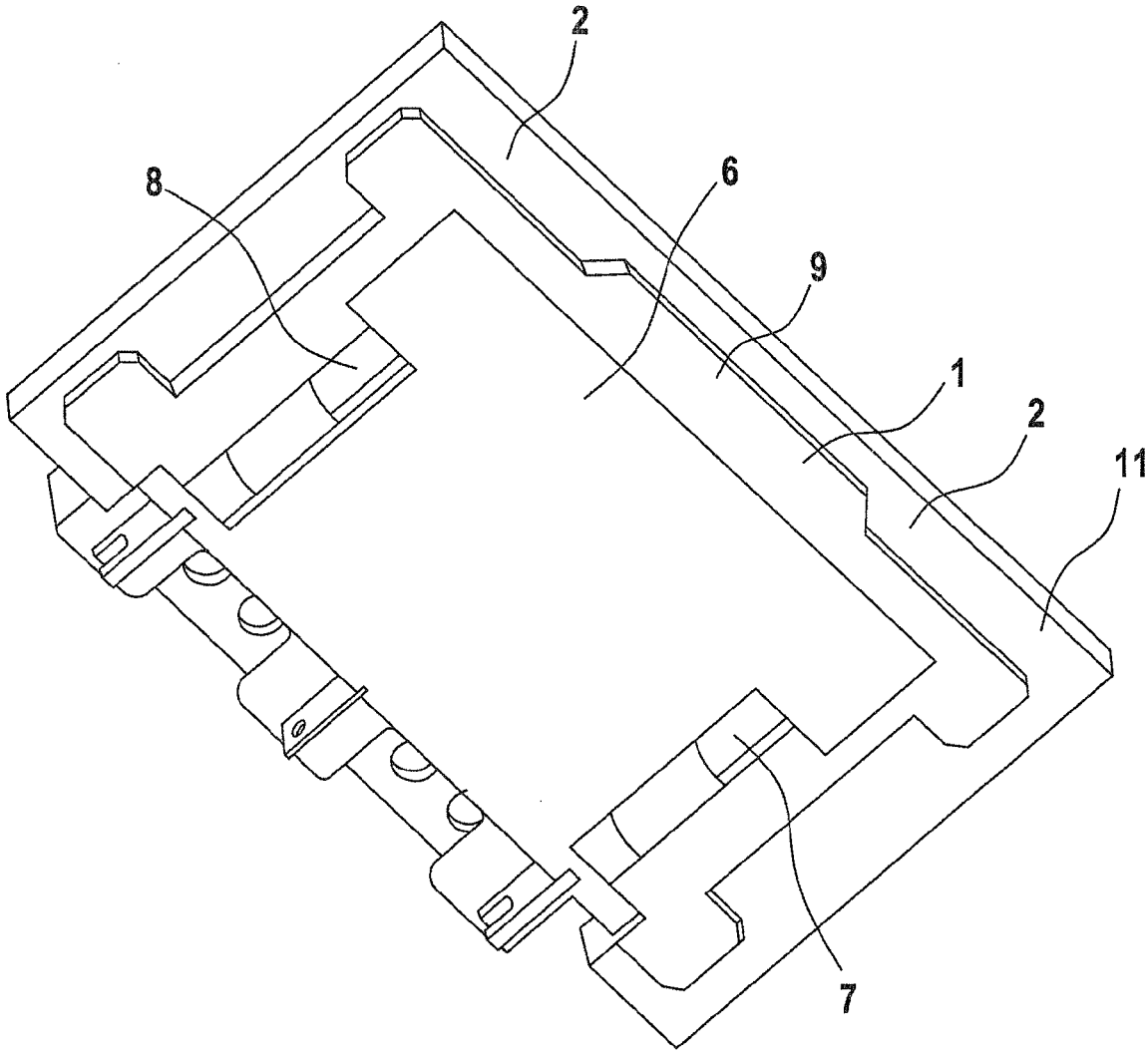
FIG. 2 is a perspective depiction of the arrangement according to FIG. 1 in a view from above.

FIG. 2 is another perspective view of the arrangement of the interface element 1 and interface element holder 2 according to FIG. 1, with the interface element 1 depicted in a view from above. The drawing shows the central hard component section 6 that is extrusion coated at the edges with the positioning section 9, which in turn affixes the interface element 1 in the interface element holder 2. The embodiment of the positioning section advantageously permits the elimination of separate fastening means. FIG. 2 shows the functional elements 7, 8 embodied in the form of electrical contacts, in a view from below. The drawing also shows that the hard component section 11 of the interface element holder 2 protrudes a certain distance in the radial direction into the positioning section 9—in other words, portions of the hard component section 11 of the interface element holder 2 are encompassed by the positioning section 9 of the interface element 1.

Figure 3:
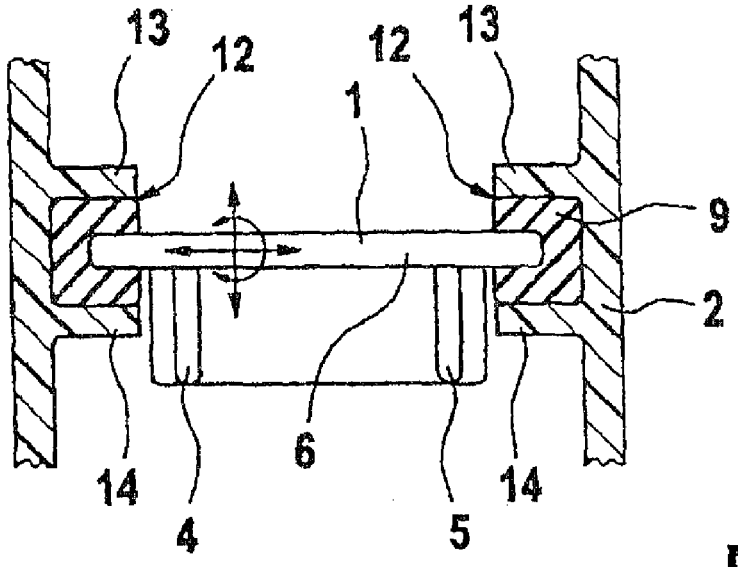
FIG. 3 is an alternative arrangement of an interface element and an interface element holder.

FIG. 3 shows a schematic, partially sectional view of an alternative embodiment, including an interface element 1 and an interface element holder 2. The interface element 1 includes a hard component section 6 to which functional sections 4, 5 embodied in the form of electrical contacts are affixed. The hard component section 6 is extrusion coated at the edge with an elastic material that constitutes a positioning section 9. The circumferential positioning section 9 in turn is accommodated in a circumferential receiving pocket 12 of the interface element holder 2; the receiving pocket 12 is in turn composed of two partitions 13, 14 of a hard component section 11 of the interface element holder 2 that extend inward, parallel to each other.

Figure 4:
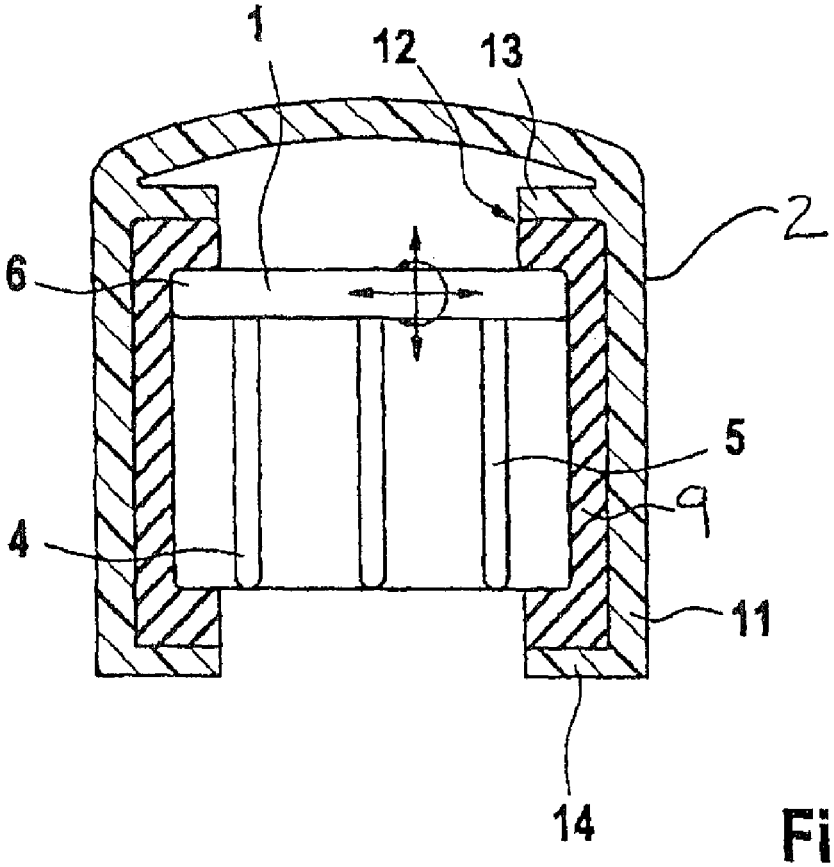
FIG. 4 is another alternative arrangement of an interface element and an interface element holder.

FIG. 4 shows an alternative arrangement, including an interface element 1 and an interface element holder 2. By contrast with the exemplary embodiment according to FIG. 3, the positioning section 9 is not an integral component of the interface element 1, but is instead an integral component of the interface element holder 2. To this end, the positioning section 9 and a hard component section 11 of the interface element holder 2 are embodied in the form of a multicomponent injection molded part. Alternatively, the positioning section 9 can also be embodied in the form of a component that is separate from the hard component section 11 and can be secured to the hard component section 11 by means of clamps, for example. In another alternative, the positioning section 9 can be affixed to the hard component section 11 by means of gluing.

As is clear from FIG. 4, the positioning section 9 is embodied as U-shaped in cross section and constitutes a receiving pocket for the interface element 1. The positioning section 9 in this case is held in a receiving pocket 12 of the interface element holder 2; the receiving pocket 12 is composed of two parallel partitions 13, 14 in an analogous fashion to the one in FIG. 3.

The positioning section 9 of the interface element holder 2 holds a hard component section 6 of the interface element 1; functional sections 4, 5 embodied in the form of electrical contacts for producing an electrical contact with a rechargeable battery are extrusion coated with the hard component section 6.

The foregoing relates to the preferred exemplary embodiments of the invention, it being understood that other variants and embodiments thereof are possible within the spirit and scope of the invention, the latter being defined by the appended claims.

The invention claimed is:

1. An interface element for affixing to and/or in an interface element holder of an electrical appliance, the interface element being equipped with a first hard component section, and a positioning section which is composed of an elastic material and is elastically deformable allowing for movement of the first hard component section relative to the interface element holder, wherein the positioning section is injection molded around edges of the first hard component section and the positioning section is secured in a recess of a second hard component section or is accommodated in a receiving pocket of the interface element holder.

2. The interface element as recited in claim 1, wherein the positioning section is composed of a plastic, in particular a thermoplastic elastomer (TPE), that is softer than the first hard component section at room temperature.

3. The interface element as recited in claim 1, wherein the positioning section and the first hard component section are embodied in the form of a single composite component, in particular a multicomponent injection molded part.

4. The interface element as recited in claim 2, wherein the positioning section and the first hard component section are embodied in the form of a single composite component, in particular a multicomponent injection molded part.

5. The interface element as recited in claim 1, wherein at least one functional section is provided on, in particular affixed to, the first hard component section and/or the first hard component section is embodied as a functional section.

6. The interface element as recited in claim 2, wherein at least one functional section is provided on, in particular affixed to, the first hard component section and/or the first hard component section is embodied as a functional section.

7. The interface element as recited in claim 3, wherein at least one functional section is provided on, in particular affixed to, the first hard component section and/or the first hard component section is embodied as a functional section.

8. The interface element as recited in claim 1, wherein the interface element is embodied in a form of an electrical interface element with a functional section embodied in the form of an electrical contact for producing an electrical contact between at least one battery and/or rechargeable battery and electrical equipment of the electrical appliance, in particular an electric motor and/or a set of electronics.

9. An interface element holder of an electrical appliance, for an interface element as recited claim 1 and equipped with a first hard component section, wherein a positioning section is provided, which is composed of an elastic material and, by deforming, permits a relative movement of the first hard component section of the interface element relative to the interface element holder.

10. The interface element as recited in claim 9, wherein the positioning section is composed of a plastic, in particular a thermoplastic elastomer (TPE), that is softer than the first hard component section of the interface element at room temperature.

11. The interface element as recited in claim 9, wherein the positioning section and a second hard component section of the interface element holder are embodied in a form of a shared composite component, in particular a multicomponent injection molded part.

12. The interface element as recited in claim 10, wherein the positioning section and a second hard component section of the interface element holder are embodied in a form of a shared composite component, in particular a multicomponent injection molded part.

13. The interface element as recited in claim 9, wherein at least one functional section, in particular an electrical contact and/or a coding element, is provided on, in particular affixed to, a second hard component section of the interface element holder and/or the first hard component section is embodied as a functional section.

14. The interface element as recited in claim 10, wherein at least one functional section, in particular an electrical contact and/or a coding element, is provided on, in particular affixed to, a second hard component section of the interface element holder and/or the first hard component section is embodied as a functional section.

15. The interface element as recited in claim 11, wherein at least one functional section, in particular an electrical contact and/or a coding element, is provided on, in particular affixed to, the second hard component section of the interface element holder and/or the first hard component section is embodied as a functional section.

16. The interface element as recited in claim 12, wherein at least one functional section, in particular an electrical contact and/or a coding element, is provided on, in particular affixed to, the second hard component section of the interface element holder and/or the first hard component section is embodied as a functional section.

17. An electrical appliance, in particular a power tool or household appliance, equipped with an interface element as recited in claim 1.

18. An electrical appliance, in particular a power tool or household appliance, equipped with an interface element holder as recited in claim 9.

19. A use of an interface element as recited in claim 1 for an electrical appliance, in particular a power tool or a household appliance.

20. A use of an interface element holder as recited in claim 9 for an electrical appliance, in particular a power tool or a household appliance.

21. The interface element as recited in claim 1, wherein the positioning section is embodied as U-shaped in cross section.

22. The interface element as recited in claim 1, wherein the receiving pocket comprises two partitions of the second hard component section that extend inward, parallel to each other.

23. The interface element as recited in claim 1, wherein portions of the first hard component section are encompassed by the positioning section.

* * * * *